United States Patent [19]

Larsen

[11] 4,283,055

[45] Aug. 11, 1981

[54] PUZZLE TYPE TOY

[76] Inventor: Donald R. Larsen, 358 E. 800 North, American Fork, Utah 84003

[21] Appl. No.: 81,882

[22] Filed: Oct. 4, 1979

[51] Int. Cl.[3] ..... A63F 9/12

[52] U.S. Cl. ..... 273/160

[58] Field of Search ..... 273/156, 157 R, 160

[56] References Cited

U.S. PATENT DOCUMENTS

| | | | |
|---|---|---|---|
| 3,612,537 | 10/1971 | Sato | 273/156 |
| 3,721,446 | 3/1973 | Young | 273/157 R |
| 3,827,162 | 8/1974 | Moeser | 273/160 X |
| 4,206,923 | 6/1980 | Cloutier | 273/160 |

FOREIGN PATENT DOCUMENTS

| | | | |
|---|---|---|---|
| 563788 | 7/1975 | Switzerland | 273/156 |

*Primary Examiner*—Anton O. Oechsle

*Attorney, Agent, or Firm*—Terry M. Crellin; B. Deon Criddle

[57] ABSTRACT

A puzzle type toy comprises a hexahedral, solid body having a plurality of bores of uniform depth extending inwardly from three sides thereof. A plurality of uniform length rods, equal in number to the number of bores in the solid body, are adapted to be inserted into the bores. The rods have various combinations of notches in the sidewalls thereof whereby the rods can all be received in the bores only when the rods are inserted in their respective bores in a particular, preset order, otherwise an interference will occur between the rods as they are inserted into the bores.

5 Claims, 6 Drawing Figures

PUZZLE TYPE TOY

BACKGROUND OF THE INVENTION

1. Field

The present invention pertains to interlocking, puzzle type toys and, more particularly, to a toy having a plurality of parts which are to be assembled in predetermined order.

2. State of the Art

Puzzle toys comprising a plurality of various shaped pieces which can be assembled in interlocking fashion to form a shape such as an animal, automobile, airplane, etc., have been widely mrketed. Generally, such puzzle toys require little ingenuity in the assembly thereof and once assembled, there is no effect or challenge in taking the puzzle apart and again assembling it. The puzzle, thus, rapidly loses its ability to amuse, and one's interest in the toys is short lived. A puzzle toy is disclosed in U.S. Pat. No. 3,612,537 issued to Jun Sato on October 12, 1971, which comprises a hexahedral hollow body whose walls are provided with through-holes of the number beginning with one and ending with six as in the case of a die. Twenty one rods classified into four kinds in respect of their lengths are adapted to be inserted into the through-holes. Allegedly, this latter toy provides sufficient challenge to amuse both children and adults as well as to be somewhat educational in cultivating one's abilities to think logically. However, the rods are not interlocking, and the rods can be inserted and removed from the through-holes in any order with the only requirement being that rods are inserted into the through holes so as to avoid interfering with each other.

3. Objectives

A principal objective of the present invention is to provide a puzzle type toy having interlocking parts which must be assembled in a predetermined order, wherein the assembly is of sufficient complexity that it provides a continuing challenge even though the puzzle has been assembled many previous times.

Another objective is to provide a toy which is amusing to children and adults and provides a challenge for them to utilize their abilities to think logically and methodically.

SUMMARY OF THE INVENTION

The above objectives are achieved in accordance with the present invention by a puzzle type toy comprising a hexahedral, solid body or cube in which a plurality of bores of substantially uniform peripheral shape and size and substantially uniform depth extend inwardly from three sides of the body. The bores are arranged so that each bore partially intersects at least one bore extending inwardly from each of the other two sides. Preferably, the bores are substantially perpendicular to the sides of the body from which they extend, and the bores are positioned so that the intersections between bores include no more than one-half the diameter of the intersecting bores. A plurality of rods, being uniform in length and equal in number to the number of bores in the solid body, are adapted to be inserted into the bores. The rods are provided with various combinations of notches in the sidewalls thereof such that the rods can all be received in the respective bores associated with the rods only when the rods are inserted into their correct respective bores in a particular preset order. Otherwise, an interference will occur between the rods as they are inserted into the bores, thereby preventing complete insertion of some of the rods into the bores. In addition, when the rods are inserted into their respective bores in the proper order, the second and subsequent rods to be inserted are adapted to lock the previously inserted rod in its respective bore in the solid body.

Additional objectives and features of the invention will become apparent from the following detailed description of a preferred embodiment of the invention, with reference to the accompanying drawings.

THE DRAWINGS

A preferred embodiment of the toy puzzle of this invention representing the best mode presently contemplated of carrying out the invention in actual practice is illustrated in the accompanying drawings, in which.

DETAILED DESCRIPTION OF THE ILLUSTRATED EMBODIMENT

Figure 1:
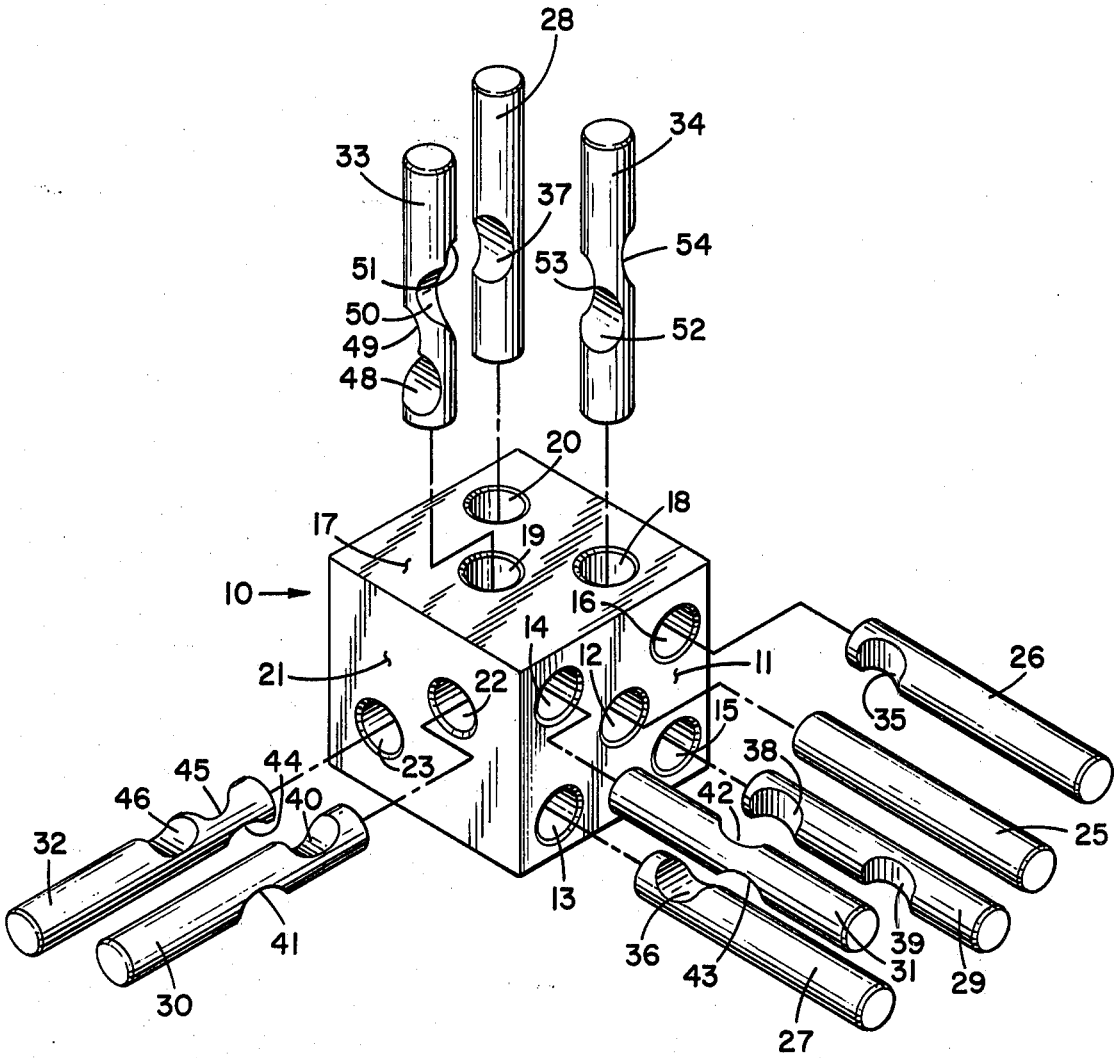
FIG. 1 is a perspective of the puzzle toy showing the rods in exploded relationship to the body portion of the toy.
Figure 2:
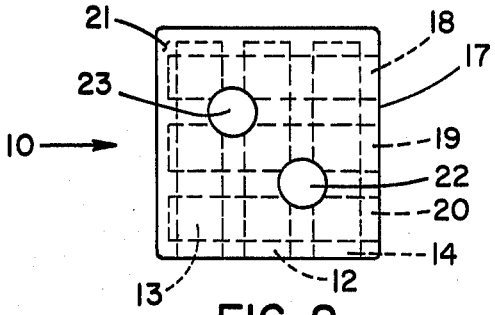
FIG. 2 is a front elevational view of the body portion of the toy, with the boreholes extending inwardly from the top and side of the body being shown by dashed lines.
Figure 3:
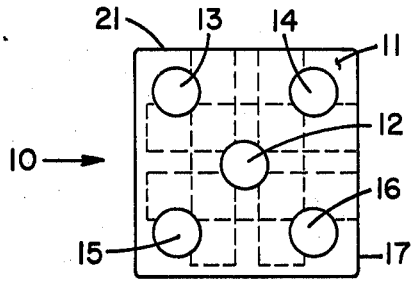
FIG. 3 is a side elevational view of the body portion of the toy, with the boreholes extending inwardly from the top and front of the body being shown by dashed lines.

In accordance with the present invention, a puzzle type toy comprises a hexahedral, solid body or block 10 having a plurality of bores of substantially uniform peripheral shape and size and substantially uniform depth. Preferably, the bores are cylindrical with uniform diameters; however, the bores could be square in cross-sectional shape or have a cross-sectional shape of any regular polygon. The bores extend inwardly from, and preferably substantially perpendicularly from three of the sides of the body 10, so that each bore extends inwardly from a respective side of the body 10 and partially intersects at least one bore extending inwardly from the other two sides of the body 10 from which bores extend.

As illustrated in FIGS. 1–4, the block 10 has the form of a cube and, preferably, has ten bores extending thereinto. One side 11 of the block 10 has five bores 12–16, respectively, extending inwardly therefrom, with one bore 12 being located at the center of side 11, and with the other four bores 13–16 located near the corners and on diagonals through the corners of side 11. The openings on side 11 of the five bores 12–16 form a square with one of the openings centered on side 11. The bores 12–16 extending from side 12 are substantially parallel with each other and the distance between the centers of the bores 13–16 forming the corners of square on side 11 is substantially three times the diameter of the bores 12–16.

Figure 4:
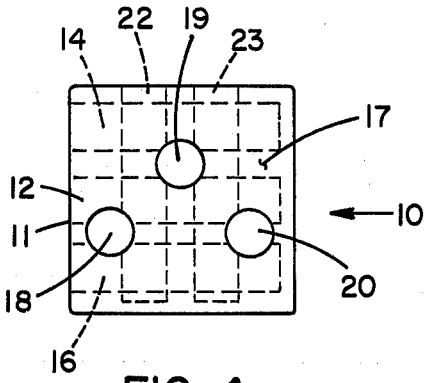
FIG. 4 is a plan view of the top of the body portion of the toy, with the boreholes extending inwardly from the front and side of the body being shown by dashed lines.

A second side 17 of the block 10 has three bores 18–20 extending inwardly therefrom. The bores 18–20 extending from side 17 are positioned so as to be located at the corners of a right triangle, with the two bores 18 and 20 at the ends of the hypotenuse of the right triangle partially intersecting two adjacent corner bores 15 and 16 and the center bore 12 which extend from side 11. As best shown in FIG. 4, the two bores 18 and 20 at the end of the hypotenuse of the right triangle formed by the openings of the bores 18–20 on side 17 of the block 10 are centered on a plane parallel to the axes of bores 15 and 16 which extend inwardly from side 11 and located equidistantly between a plane containing the axes of bores 15 and 16 and the axis of the center bore 12. Thus, both bores 18 and 20 partially intersect the center bore 12 and the corner bores 15 and 17 which extend from side 11 of block 10. The third bore 19 extending from side 17, i.e., the bore whose opening is at the right angle of the right triangle formed by the openings of bores 18–20 on side 17, is centered on a plane parallel to the axes of bores 13 and 14 extending from side 11 and located equidistantly between a plane containing the axes of bores 13 and 14 and the axis of the center bore 12. Thus, bore 19 partially intersects the center bore 12 and the corner bores 13 and 14 which extend from side 11 of block 10.

A third side 21 of the block 10 has two bores 22 and 23 extending inwardly therefrom. The bores 22 and 23 extending from side 21 are located on a diagonal through the corners of side 21, so that the axes of bores 22 and 23 are parallel, respectively, to a plane containing the axes of bores 14 and 16 and a plane containing the axes of bores 13 and 15. One bore 22, which extends from side 21, is centered on a plane which is parallel to the axes of bores 13 and 15 and which is also located equidistantly between a plane containing the axes of bores 13 and 15 and the axis of the center bore 12 (see FIGS. 2 and 3). Thus, the bore 22 partially intersects the center bore 12 and the bores 13 and 15 which extend inwardly from side 11 of block 10. The other bore 23, which extends from side 21, is centered on a plane which is parallel to the axes of bores 14 and 16 and which is also located equidistantly between a plane containing the axes of bores 14 and 16 and the axis of the center bore 12 (see FIGS. 2 and 3). Thus, the bore 23 partially intersects the center bore 12 and the bores 14 and 16 which extend inwardly from side 11 of block 10. In addition to partially intersecting bores 13 and 15, which extend inwardly from side 11, bore 22 also partially intersects bores 18 and 19, which extend inwardly from side 17 of block 10. Bore 23, in addition to partially intersecting bores 14 and 16, which extend inwardly from side 11, also partially intersects bores 19 and 20, which extend inwardly from side 17 of block 10.

As illustrated, the bores are positioned so that the interference at the partial intersections between bores includes about one-fourth the diameter of each bore. However, the spacing of the bores can be varied such that from about one-fifth to about one-half of the bores are included at the partial intersections. As illustrated by the dashed lines in FIGS. 2–4, the bores extend only partially through body 10.

Figure 5:
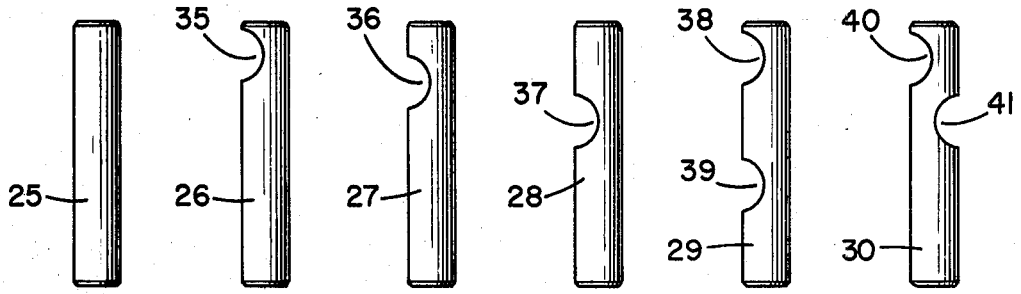
FIG. 5 shows six rods used in the toy of FIG. 1, with each rod shown in side elevation.

A set of rods of uniform length and having a peripheral shape so as to be adapted for insertion into the bores in block 10 are provided. Preferably, the rods are substantially cylindrical in shape to be accepted in the cylindrical bores; however, when the bores are of a square or other regular polygon shape, the rods are of the same shape so as to be accepted in the bores. The rods have a cross-sectional size which is adapted to be slidably received in the bores with a small clearance between the sides of the bores and the sides of the rods. Inasmuch as there are ten cylindrically-shaped bores in the illustrated, preferred embodiment, ten rods of substantially cylindrical shape are provided as shown. Six of the ten rods are shown in FIG. 5 in side elevations. The other four rods are shown in side and front elevations in FIG. 6. All ten rods are shown in exploded assembly in FIG. 1.

Rod 25 may have a continuous peripheral surface as shown or it may have any number of notches, with the notches being similar with those to be described hereinafter with respect to the other nine rods. The notches in all the rods as illustrated are circular with the depth of the notches being at least as great as the amount of interference at the partial intersections of the bores in block 10. Preferably, the depth of the notches is about one-half the diameter of the rods themselves. If the bores and rods have cross-sectional shapes other than that of circular, the notches are made of a shape to conform with that of the bores and rods, i.e., if the bores and rods have a square cross-sectional shape, the notches will also have a square shape.

Rod 26 has a notch 35 adjacent to one end thereof. Rod 27 has a notch 36 near one end thereof, with the center of the notch 36 being located a distance from the one end of the rod 26 equal to about 1.25 times the diameter of the rod 27. The notch 36 is positioned such that when rod 27 is fully inserted in bore 13, the notch 36 can be aligned with bore 23 at the intersection of bore 13 and bore 23. Rod 28 has a notch 37 spaced from one end thereof, with the center of the notch 37 being located a distance from the end of rod 28 equal to about two times the diameter of rod 28. The notch 37 is positioned such that when rod 28 is fully inserted in bore 20, the notch 37 can be aligned with bore 12 at the intersection of bore 20 and bore 12. Rod 29 has two notches 38 and 39 therein which face the same direction. Notch 38 is positioned adjacent to one end of rod 29, and notch 39 is spaced therefrom so that the center of notch 39 is located a distance from the end adjacent to notch 38 of about three times the diameter of rod 29. The notches 38 and 39 are positioned such that when rod 29 is fully inserted into bore 15, notch 38 can be aligned with bore 20 at the intersection of bore 15 and bore 20, and notch 39 can be simultaneously aligned with bore 18 at the intersection of bore 15 and bore 18. Rod 30 is similar to rod 29 in that it has two notches 40 and 41; however, the notches 40 and 41 face in opposite directions. Notch 40 is positioned adjacent to one end of rod 30, and notch 41 is spaced from that end of rod 30, with the center of notch 41 being positioned a distance of about two times the diameter of rod 30 from the end thereof adjacent to notch 40. The notches 38 and 39 are positioned such that when rod 30 is fully inserted into bore 22, notch 40 can be aligned with bore 11 at the intersection of bore 22 and bore 11, and notch 41 can be simultaneously aligned with bore 12 at the intersection of bore 22 and bore 12.

Figure 6:
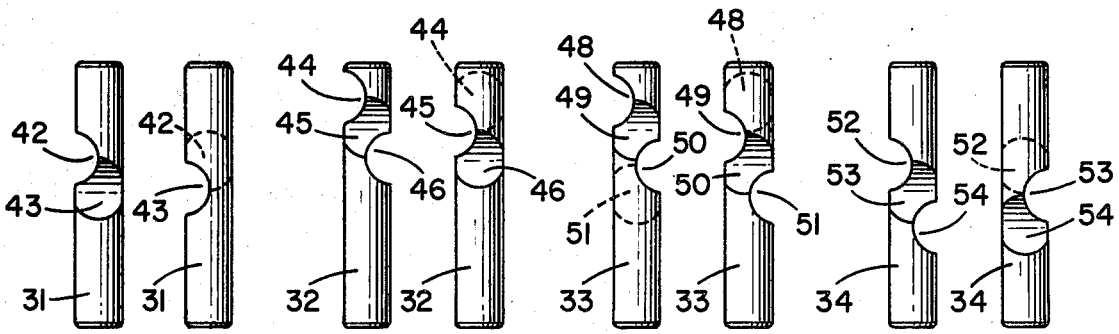
FIG. 6 shows four additional rods used in the toy of FIG. 1, with each rod shown both in front and side elevational views.

Rods 31–34 all have combinations of at least two notches which face at right angles to each other, and, thus, are shown in front and side elevations in FIG. 6 for clarity. Rod 31 has a pair of notches 42 and 43 which are arranged so as to overlap each other and face at right angles to each other. Notch 42 is spaced from one end of rod 31 so that the center of notch 42 is located from that end by a distance of about two times the diameter of rod 31. Notch 43 overlaps about one-half of notch 42, and is, thus, located such that the center of notch 43 is spaced from the one end of rod 31 by a distance of about 2.5 times the diameter of rod 31. The notches 42 and 43 are positioned such that when rod 31 is fully inserted into bore 14, notch 42 can be aligned with bore 19 at the intersection of bore 14 and bore 19, and notch 43 can be simultaneously aligned with bore 22 at the intersection of bore 14 and bore 22.

Rod 32 has three notches 44, 45, and 46, therein. Notches 44 and 46 face in opposite directions, with notch 44 positioned adjacent one end of rod 32 and with the center of notch 46 spaced from the same end of rod 32 by a distance of about two times the diameter of rod 32. The third notch 45 faces at right angles to and overlaps notches 44 and 46, with the center of notch 45 being spaced from the one end of rod 32 by a distance of about 1.5 times the diameter of rod 32. The notches 44, 45, and 46 are positioned such that when rod 32 is fully inserted into bore 23, notch 44 can be aligned with bore 15 at the intersection of bores 23 and 15, notch 45 can be simultaneously aligned with bore 20 at the intersection of bores 23 and 20, and notch 46 can be simultaneously aligned with bore 12 at the intersection of bores 23 and 12.

Rod 33 has four notches 48, 49, 50, and 51 therein. Notches 48 and 50 face in opposite directions, with notch 48 positioned adjacent one end of rod 33 and with the center of notch 50 spaced from the same end of rod 33 by a distance of about two times the diameter of rod 33. The third notch 49 faces at right angles to and overlaps notches 48 and 50, with the center of notch 49 being spaced from the one end of rod 33 by a distance of about 1.5 times the diameter of rod 33. The fourth notch 51 faces the opposite direction of notch 49 while overlapping the lower portion of notch 50, with the center of notch 51 being spaced from the one end of rod 33 by a distance of about three times the diameter of rod 33. The notches 48, 49, 50, and 51 are positioned such that when rod 33 is fully inserted into bore 19, notch 48 can be aligned with bore 13 at the intersection of bores 19 and 13, notch 49 can be simultaneously aligned with bore 23 at the intersection of bores 19 and 23, notch 50 can be simultaneously aligned with bore 22 at the intersection of bores 19 and 22, and notch 51 can be simultaneously aligned with bore 12 at the intersection of bores 19 and 12.

Rod 34 has three notches 52, 53, and 54 therein. Notches 52 and 54 face in opposite directions, with the center of notch 52 spaced from one end of rod 34 by a distance of about two times the diameter of rod 32 and with the center of notch 54 spaced from the same end of rod 34 by a distance of about 3.5 times the diameter of rod 34. The third notch 53 faces at right angles to and overlaps notches 52 and 54, with the center of notch 53 being spaced from the one end of rod 34 by a distance of about three times the diameter of rod 34. The notches 52, 53, and 54 are positioned such that when rod 34 is fully inserted into bore 18, notch 52 can be aligned with bore 12 at the intersection of bores 18 and 12, notch 53 can be simultaneously aligned with bore 22 at the intersection of bores 18 and 22, and notch 54 can be simultaneously aligned with bore 16 at the intersection of bores 18 and 16.

The ten rods 25–34 can all be fully and simultaneously received in the ten bores 12–16, 18–20, 22, and 23 only when the respective rods are inserted into their respective bores in a particular order, otherwise an interference will occur between the rods as they are inserted into the bores. In the embodiment illustrated, rod 31 is the first rod to be inserted into its corresponding bore in block 10. It is inserted into bore 14 and then rotated so that the notches 42 and 43 therein are aligned with bores 19 and 22, respectively, whereupon the remaining nine bores 12, 13, 15, 16, 18–20, 22, and 23, into which rods have not been inserted, are left unimpeded.

Rod 33 is the second rod to be inserted into a bore in block 10. It is inserted into bore 19, and then rotated so as to align the notches 48, 49, 50 and 51 therein with bores 13, 23, 22, and 12, respectively. The remaining eight bores 12, 13, 15, 16, 18, 20, 22, and 23 in block 10 are then left unimpeded. It should be noted that the insertion of rod 33 locks the previously inserted rod 31 in its inserted position in bore 14, inasmuch as rod 31 engages notch 42 of rod 31. It is a feature of the present invention that as a subsequent rod is correctly inserted into its corresponding bore, the previously inserted rod is locked into its inserted position in block 10.

The next rod to be inserted is rod 27, and it is inserted into bore 13. After insertion, rod 27 is rotated so as to align notch 36 therein with bore 23, and leave the remaining seven bores 12, 15, 16, 18, 20, 22, and 23 unimpeded. Rod 27 engages notch 48 in rod 33 and thereby locks rod 33 in its inserted position in bore 19.

Rod 32 is next inserted into bore 23 and rotated so as to align notches 44, 45 and 46 therein with bores 15, 20, and 12, respectively. Bores 12, 15, 16, 18, 20, and 22 bores in block 10 are left unimpeded. Rod 32 engages notch 36 in rod 27 and thereby locks rod 27 in its inserted position in bore 13.

Rod 29 is then inserted into bore 15 and rotated so that the notches 38 and 39 therein are aligned with bores 20 and 18, respectively, and bores 12, 16, 18, 20, and 22 are left unimpeded. Rod 29 engages notch 44 in rod 32 and thereby locks rod 32 in its inserted position in bore 23.

Next, rod 34 is inserted into bore 18 and rotated so that the notches 52, 53, and 54 therein are aligned with bores 12, 22, and 16, respectively, whereby bores 12, 16, 20, and 22 are left unimpeded. Rod 34 engages notch 39 of rod 29 and thereby locks rod 29 in its inserted position in bore 15.

Rod 30 is then inserted into bore 22 and rotated so that the notches 40 and 41 therein are aligned with bores 16 and 12, respectively. Bores 12, 16, and 20 are, thus, left unimpeded. Rod 30 engages notch 53 of rod 34 and thereby locks rod 34 in its inserted position in bore 18.

Rod 26 is next inserted into bore 16 and rotated so that notch 35 therein is aligned with bore 20. This leaves only bores 12 and 20 unimpeded. Rod 26 engages notch 40 of rod 30 and thereby locks rod 30 in its inserted position in bore 22.

The next to last rod 28 is then inserted into bore 20 and rotated so that notch 37 therein is aligned with bore 12, whereupon bore 12 is the only bore left unimpeded. Rod 28 engages notch 35 of rod 26 and thereby locks rod 26 in its inserted position in bore 16. The last rod 25 is inserted into bore 12. Rod 25 engages notch 37 of rod 28 and thereby locks rod 28 in its inserted position in bore 20. The rods are removed from the bores in block 10 in the opposite order in which they were inserted.

It should be noted that rod 25, the last rod to be inserted, could have one or more notches in its surface so that it would not be as readily recognized as being the last rod inserted during assembly of the puzzle.

Further, up to three additional bores could be provided extending inwardly from side 17 of block 10 and up to two additional bores could be provided extending inwardly from side 21 of block 10. However, the puzzle is sufficiently challenging when ten bores and rods are involved, and the addition of more bores and rods increases the difficulty experienced in assembling the puzzle considerably. Numerous other arrangements of notches can be devised for the rods such that the rods can be all fully inserted into the bores of the puzzle only when inserted in a preset, particular order, and wherein each rod locks the previously inserted rod in place in the puzzle.

It should further be recognized that other variations and modifications may be effected in the puzzle of this invention without departing from the subject matter coming within the scope of the attached claims, which subject matter is regarded as the invention.

I claim:

1. A puzzle type toy comprising a hexahedral, solid body having a plurality of bores of uniform depth extending inwardly only partially through said body from three sides thereof so that each bore extending inwardly from a side of said body partially intersects at least one bore extending inwardly from the other two sides thereof, and a plurality of rods, one rod having either substantially continuous longitudinal side walls or one or more notches therein and the other rods having at least one notch in the sidewalls thereof at various positions around and along the length of said other rods, whereby the rods are all received in the bores only when the rods are inserted in their respective bores in a particular order with said one rod being the last rod to be inserted into its respective bore, otherwise an interference will occur between said rods as they are inserted into the bores at the partial intersections of the bores in said solid body.

2. A toy in accordance with claim 1, wherein the second and subsequent rods are adapted to lock the previously inserted rod in its respective bore in said solid body.

3. A toy in accordance with claim 1, wherein said bores extend substantially perpendicularly inwardly from the three sides of said hexahedral, solid body.

4. A toy in accordance with claim 3, wherein one side of said solid body has five bores extending inwardly therefrom with one of the bores in said one side being located at the center thereof and with the other four bores in said one side located near the corners of said one side and on diagonals through the corners of said one side; a second side of said solid body has three bores extending inwardly therefrom so that the bores in said second side are located at the corners of a right triangle, with the two bores at the ends of thehypotenuse of said right triangle partially intersecting two corner bores and the center bore of said one side and with the bore at the right angle of said right triangle partially intersecting the other two corner bores and the center bore of said one side; and a third side of said solid body has two bores extending inwardly therefrom so that the bores in said third side are located on a diagonal through the corners of said third side, with one bore in said third side partially intersecting two corner bores and the center bore of said one side and with the other bore in said third side partially intersecting the other two corner bores and the center bore of said one side.

5. A puzzle toy in accordance with claim 1, wherein the bores and rods are substantially cylindrical in shape.

* * * * *